United States Patent [19]

Reichert

[11] 3,987,710

[45] Oct. 26, 1976

[54] CARTON SQUARING MECHANISM IN A CASE ERECTOR

[75] Inventor: Donald G. Reichert, Tarpon Springs, Fla.

[73] Assignee: ABC Packaging Machine Corporation, Tarpon Springs, Fla.

[22] Filed: Jan. 21, 1976

[21] Appl. No.: 650,948

Related U.S. Application Data

[62] Division of Ser. No. 496,028, Aug. 9, 1974, Pat. No. 3,952,636.

[52] U.S. Cl. ..... 93/36 SQ; 93/36.3

[51] Int. Cl.[2] ..... B31B 1/02

[58] Field of Search ..... 93/36 SQ, 53 R, 53 M, 93/53 SD, 49 R, 36.3; 53/374

[56] References Cited

UNITED STATES PATENTS

| | | | |
|---|---|---|---|
| 3,312,154 | 4/1967 | Pierce | 93/36.3 X |
| 3,473,447 | 10/1969 | Ullman et al. | 93/36.3 |
| 3,620,138 | 11/1971 | Neal et al. | 93/36.3 |

*Primary Examiner*—James F. Coan

*Attorney, Agent, or Firm*—Newton, Hopkins & Ormsby

[57] ABSTRACT

A machine is disclosed for erecting cases stored in upright, flattened positions in storage magazines. The machine includes means for extracting end member cases from the magazines, for dropping the extracted cases into drop chutes, for urging the cases in a generally horizontal direction out of the drop chutes, for opening the flattened cases by spreading the case sides apart, for tucking in lower case end flaps, for folding one case bottom panel in under the tucked end flaps, for applying adhesive to the bottom surface of the folded bottom panel, for folding another bottom panel in under the bottom panel having adhesive thereon, and for compressing the two bottom panels together.

3 Claims, 16 Drawing Figures

CARTON SQUARING MECHANISM IN A CASE ERECTOR

This is a division of application Ser. No. 496,028, filed Aug. 9, 1974, now U.S. Pat. No. 3,952,636.

BACKGROUND OF THE INVENTION

This invention relates generally to case erecting machines, and particularly to machines, apparatuses and methods for erecting cases stored in flattened positions within one or more storage magazines.

Machines have heretofore been devised for erecting cases stored in flattened position for subsequent packing of goods. U.S. Pat. Nos. 3,626,661, 3,637,129 and 3,763,750, which patents are assigned to the assignee of the present invention, exemplify such machines. In general, these machines serve to open the flattened cases and to fold in and secure together the bottom case flaps. Subsequently, the cases are packed with goods and the top panels folded and sealed.

Though case erecting machines of the prior art have been successfully employed in automatically erecting flattened cases for packaging, they have not been free of problems. For example, where the cases are stored in upright positions for one at a time dispensing, it is continuously necessary to present an end member case at an extraction station at one end of the storage magazine where it may be gripped by extracting mechanisms. Some machines have employed continuously rotating drive shafts or augers upon which the case blanks are supported and rotated for continuously urging them towards the magazine end extraction stations. This constant rotation of augers beneath the cases, however, often deforms the bottom edges of the cases through constant rubbing action. The continuous rotation of the shafts also consumes power needlessly when case movement is not required. A dilemma is also presented here in providing positive stop means against which end member cases may be urged where an extraction exit must also be located.

In addtion to the just mentioned difficulties encountered in extracting end member cases one at a time from storage magazines, the box erecting mechanisms of prior art machines have met with relatively limited success in squaring the corners of the cases during the erecting process. For example, in initially opening the flattened, usually cardboard cases the wall hinges tend to "remember" their former orientations. This memory causes the walls to tend to return somewhat toward their previous orientation after having been physically opened. Thus, where the sides of the cases are brought into right angle corner hinged positions means must ordinarily be provided for maintaining this angle or else the box sides will self-assume an acute or obtuse angle in their tendency to return to their previous flattened position.

Another squaring problem is presented in the process of glueing together bottom panel members of the cases during erection. As the cases proceed through the various operative stations within the machine they typically move in a generally horizontal direction. At one point in their travel at least one of their bottom panels is passed over apparatus for applying an adhesive coating to the bottom thereof. Once the case is urged out of this station another bottom panel member is folded in upon the glue bearing surface of the other bottom panel. As the two panel members come together one panel member will tend to slip over the surface of the other panel member due to the frictional drag imparted thereto by the overall movement of the case in a traverse direction with respect to that of the closing panels. This drag tends to throw the sides of the cases out of square.

Yet anotehr squaring problem is presented in the panel compression station where the glued bottom panels are compressed to form a firm seal. Typically, in compressing the bottom panels the cases are positioned upon an anvil and a mandrel is then passed into the container through the open top thereof and onto the upper surface of the upper case bottom panel and end flaps whereby the two case bottom panels are compressed between the anvil and mandrel. At this station the movement of the case through the machine has typically been arrested in order to avoid having to mount the mandrel and anvil thereunder for horizontal movement in company with the cases. In accomplishing this the cases are typically urged by flight bars or the like up against a stop whereupon the flight bars break contact with the cases. However, once this positive contact is broken the cases placed against the stops are free to move out of square since there is no continuing force being applied to press the cases firmly against the stops. Should the mandrel then descend towards the interior of the case it may contact the top thereof and crush the case rather than passing into the interior thereof. Where the width of the mandrel is reduced in order to insure that clean passage will be achieved all portions of the bottom panels will not be encountered by the descending mandrel and thus not subjected to uniform compression.

Accordingly, it is a general object of the present invention to provide an improved case erecting machine.

More specifically, it is an object of the present invention to provide improved methods and apparatuses for dispensing case blanks one at a time from a stack of flattened cases juxtaposed in upright positions in one or more case magazines.

Another object of the invention is to provide improved apparatus for simultaneously dispensing pairs of cases stored in flattened positions in a plurality of magazines.

Another object of the invention is to provide improved methods and apparatuses for opening flattened cases having one side and one end disposed along a first plane and an opposite side and end disposed along a second plane closely parallelling the first plane.

Another object of the invention is to provide improved methods and apparatuses for securing bottom panel members of cases together.

Another object of the invention is to provide improved apparatuses for squaring the sides of cases being moved along a preselected path within a case erecting machine.

Another object of the invention is to provide a case erecting machine whose moving components generally move at uniform velocities thereby minimizing or completely avoiding intermittent motions.

Yet another object of the invention is to provide case erecting machine requiring minimal use of hydraulic or air cylinders and timing controls for such cylinders.

PRINCIPLED FEATURES OF THE MACHINE

In one form of the invention apparatus is provided for simultaneously dispensing pairs of cases stored in flattened upright positions. The apparatus comprises a pair of mutually spaced magazines having open ends facing one another and a pair of suction cups facing away from one another towards the magizine open ends. Means are provided for reciprocally moving the suction cups between positions in and out of the magazine open ends. means are also provided for intermittently applying suction to the suction cups.

In another form of the invention, apparatus is provided for dispensing cases one at a time from a stack of flattened cases juxtaposed in upright positions. The dispensing apparatus comprises a suction cup coupled with a vacuum pump and a carriage supporting the suction cup for reciprocal movement along a generally horizontal path into and out of engagement with end member cases of the stack. A drop chute is disposed beneath the path. Means are provided for controlling the suction applied to the suction cup by the vacuum pump whereby the suction cup may grip and remove end member cases one at a time from the stack along the path to a position over the drop chute and there release the cases enabling them to fall down into the drop chute.

In another form of the invention, apparatus is provided for dispensing cases one at a time from two stacks of flattened cases juxtaposed in upright positions. The apparatus comprising two suction cups coupled with vacuum pump means and a carriage supporting the two suction cups in oppositely facing directions for reciprocal movement along two planar paths, respectively, into and out of engagement with end member cases of the two stacks. Drop chutes are disposed beneath the paths and means provided for intermittently applying suction to the two suction cups of suffficient strength to extract the end member cases from the stacks and deliver them to release positions above the drop chutes.

In another form of the invention, a method is provided for dispensing cases one at a time from a stack of flattened cases supported in upright positions in a storage magazine. In practicing the method an end member case is urged against case periphery engaging magazine end stops. A suction cup is positioned between the magazine end stops adjacent a central portion of the end member case. Suction is applied to the suction cup whereby the suction cup grips a central portion of the end member case. The suction cup is moved away from the magazine and stack thereby urging the periphery of the end member case over the case periphery engaging magazines end stops. The suction applied to the suction cup is then diminished causing the end member case to fall free from the cup.

In yet another form of the invention a method is provided for opening flattened cases having one side and one end disposed along a first plane and an opposite side and end disposed along a second plane closely parallelling the first plane and with each case end being of substantially equal width. In accordance with the method the one side is gripped with the first suction cup means and the opposite side with second suction cup means. The second suction cup means is moved with respect to the first suction cup means a distance slightly greater than the end width as measured in a direction parallel to the first and second planes. The case sides are then released from the first and second suction cup means enabling each end to assume a substantially right-angle orientation with respect to each case blank side.

In another form of the invention apparatus is provided for opening flattened cases having one side and one end disposed along a first plane, and an opposite side and an opposite end disposed along a second plane closely parallelling the first plane. The apparatus comprises first and second suction cups and means for applying suction thereto. Means are provided for pivoting one of the suction cups through a substantially circular arc slightly greater than 90°.

In accordance with another feature of the invention a method is provided for securing two upright, mutually spaced bottom panels of a case together wherein one panel is folded in towards the other panel to a generally horizontal position and adhesive applied to the bottom side thereof. The other panel is then folded beneath the one panel to a position closely underlaying the bottom side of the first panel but in spaced relation therewith. The other bottom panel is then moved upwardly against the bottom side of the folded one panel while simultaneously applying a downwardly directive force upon the upper surface of the folded one panel thereby compressing the two panels together.

In yet another form of the invention apparatus is provided for squaring the sides of a case being moved along a preselected path. The apparatus here comprises a case stop and means for positioning the stop along the preselected path. A pair of mounting plates is pivotally mounted to opposite sides of the path with spring means provided biasing the mounting plates inwardly towards the path. A pair of rollers are rotatedly supported upon the mounting plates for rotatable engagement with the sides of the cases.

Another feature of the invention is the provision of apparatus for pressing two overlaying bottom panels of a case together for adherence which apparatus comprises an anvil and means for urging a case onto the anvil with two case panels overlaying one another in closely spaced mutual relation. A mandrel is provided detailing configuration to descend into the case into pressing abutment with at least one of the case bottom panels. Means are also provided for reciprocally moving both the mandrel and the anvil towards and away from one another is compressing the overlaying bottom panels together.

In yet another form of the invention a method is provided for erecting cases stored in upright flattened positions in a pair of magazines. In accordance with the method end member cases are simultaneously moved from each magazine and extracted cases are dropped into drop chutes and then urged in a generally horizontal direction out of the chutes. The flattened cases are opened by spreading the case sides apart. The lower case end flaps are tucked in and one case bottom panel folded in under the tucked bottom end flaps. Adhesive is applied to the folded bottom panel and another bottom panel folded in thereunder. The two bottom panels are then compressed together for a finite period of time.

DETAILED DESCRIPTION OF THE DRAWING

I. GENERAL DESCRIPTION

Figure 1:
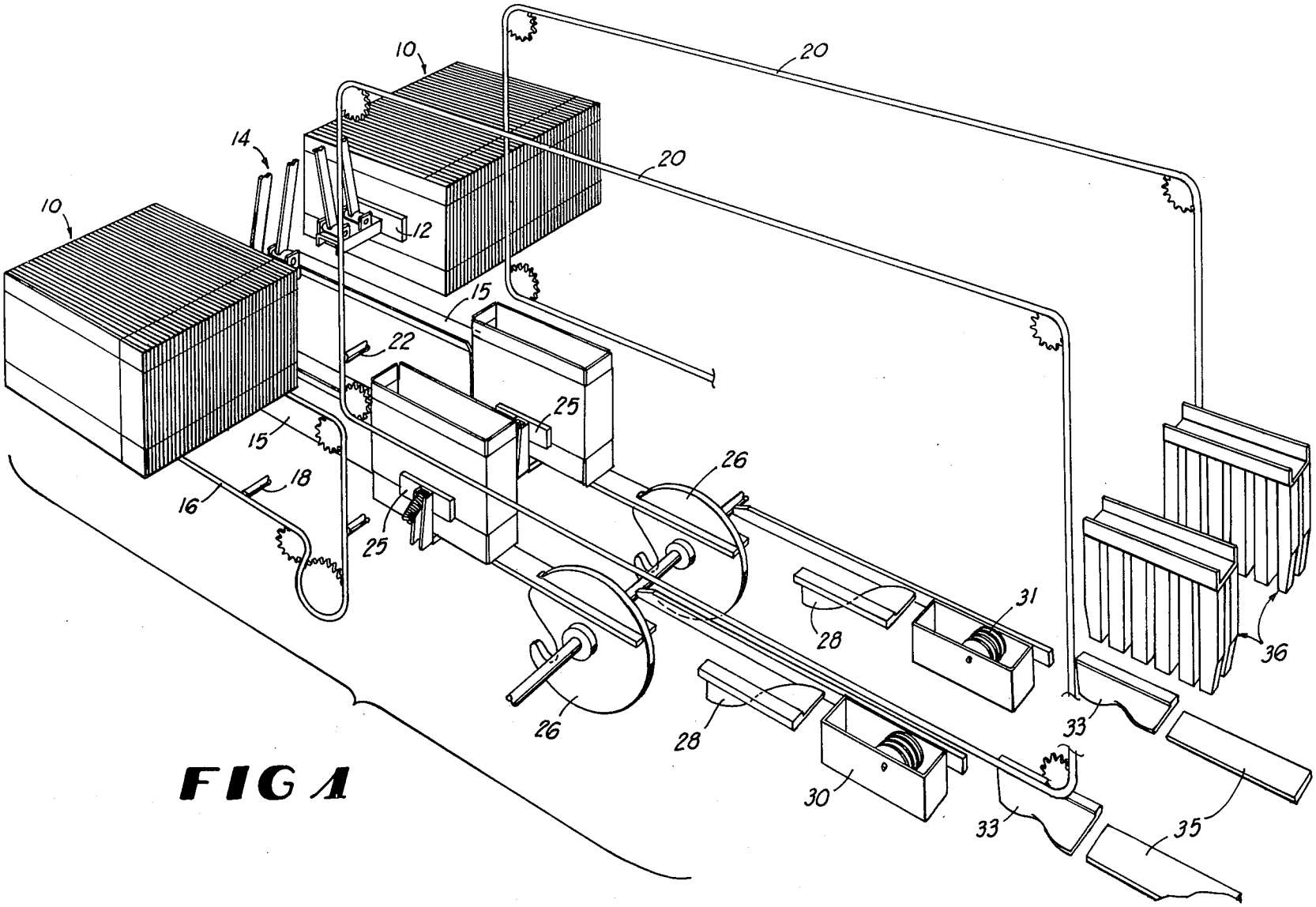
FIG. 1 is a schematic view, in perspective, of a machine embodying principles of the invention in one preferred form.

In FIG. 1 the basic components of a machine embodying principles of the invention are schematically illustrated for purposes of general depicting of various functions performed at various machine stations. Basically, the case erecting machine is capable of extracting flattened cases one at a time from two stacks, of cases, opening the cases, tucking in the bottom end flaps, folding in and applying glue to a bottom panel and then compressing the bottom panels together to form a good seal.

Two sets of flattened cases 10 are juxtaposed vertically with end members of each set facing one another. The end member cases may be extracted one at a time by suction cups 12, which are supported on a carriage 14, and then positioned over and dropped into two parallel drop chutes 15. The individual cases are then urged horizontally out of the drop chutes by means of two flight chains 16 which support horizontally extending sets of mutually spaced flight bars 18. Each case is then brought by means of another flight chain 20 to which horizontal flight bars 22 are secured between two confronting suction cups for opening. Here, one side of each case is momentarily gripped by an unshown stationary suction cup while a movable suction cup 25 grips the opposite side and pivots causing the case to swing open to the illustrated position.

From the opening station the cases are urged by flight bars 22 over rotable cams 26 which tuck in both the leading and trailing bottom end flaps. Following this, the cases are urged over stationary cams 28 which fold in one of the bottom panels. Continued case movement brings the folded bottom panel over glue boxes 30 in which are rotatably housed a set of glue discs 31 which apply glue to the bottom surface of the folded bottom panel and to the bottom surfaces of those portions of the tucked in end flaps not covered by the folded bottom panel. Next, the still unfolded bottom panel is positioned closely adjacent the just coated bottom panel by stationary cams 33. The cases are then delivered above anvils 35 and mandrels 36 lowered into the opened top of the cases and against the upper surface of the bottom panels and end flaps whereby the anvils and mandrels compress the bottom panels and flaps together to form an adhesive seal. Finally, the cases are ejected from the machine for packaging.

II. CASE STORAGE AND DISPENSING STATION

Referring now to FIGS. 2A, 3, 4A, 4B and 5 the case storage and dispensing stations may be seen in more detail. The case stacks 10 are seen to be stored in two storage magazines 40 upon pairs of threaded shafts 42 which may be rotated in mutually opposing directions when coupled with a drive chain 44 by air clutches 45. Drive chain 44 is in turn coupled with primary drive chain 46 by an intermediate chain 48. The end of the drive shafts opposite the air clutches are journaled in a transverse support 50 having an upper lip 51 which serves as a lower stop for the periphery of end member cases. A transverse bar 53 provides an upper case peripheral stop. The presence of end members flush against the stops are sensed by limit switches 52 by contact with spring biased switch actuators 55. Limit switches 52 are operatively coupled with clutches 45 whereby threaded shafts 42 are rotated whenever switch actuators 55 are not extended by the presence of an end member case of stack 10 positioned against support 50. Thus, in operation the threaded shafts are intermittently driven by the constantly driven primary drive chain 46.

Figure 4A:
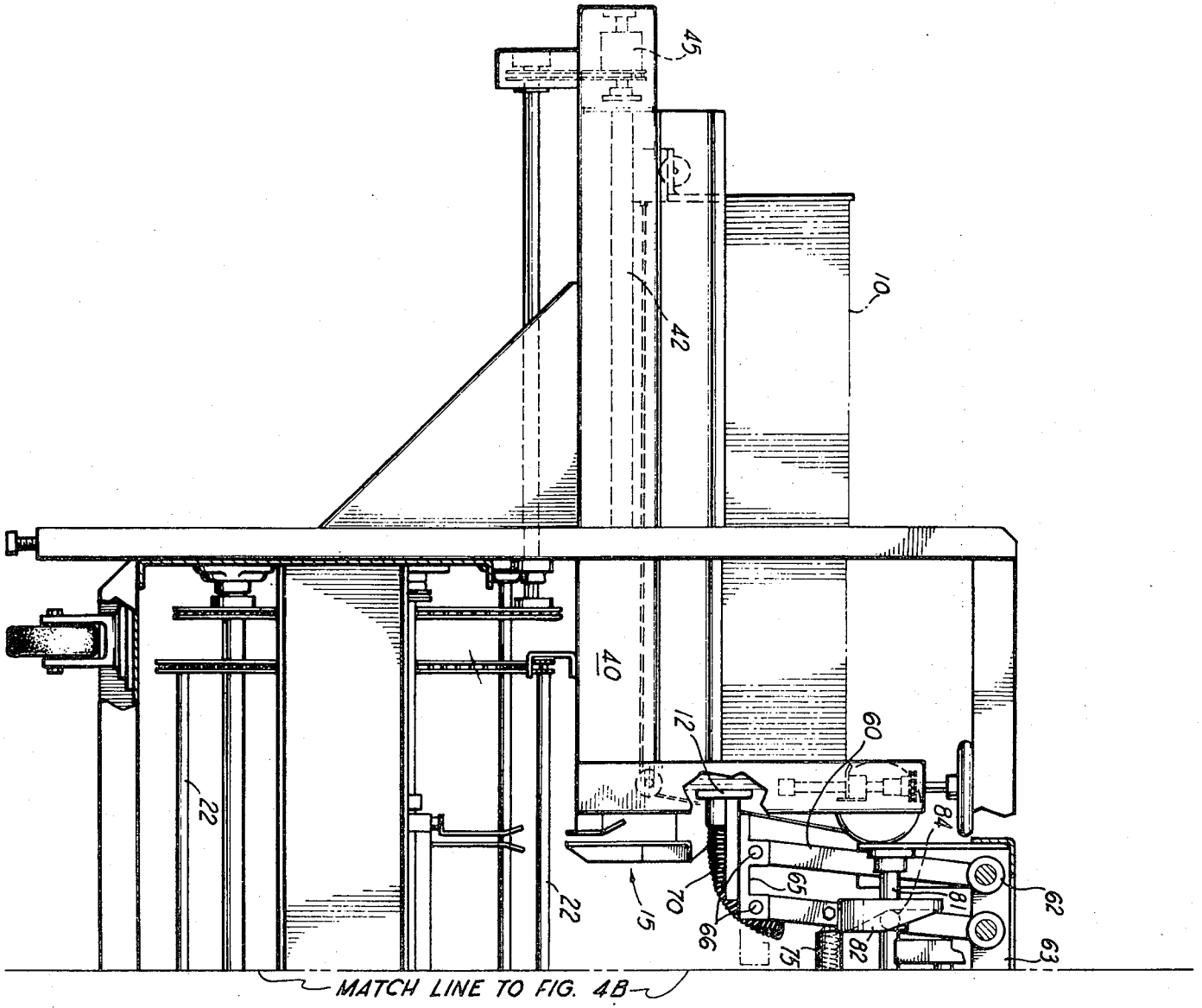
FIGS. 4A and 4B together form an end-on view of that portion of the machine illustrated in FIG. 2A.
Figure 4B:
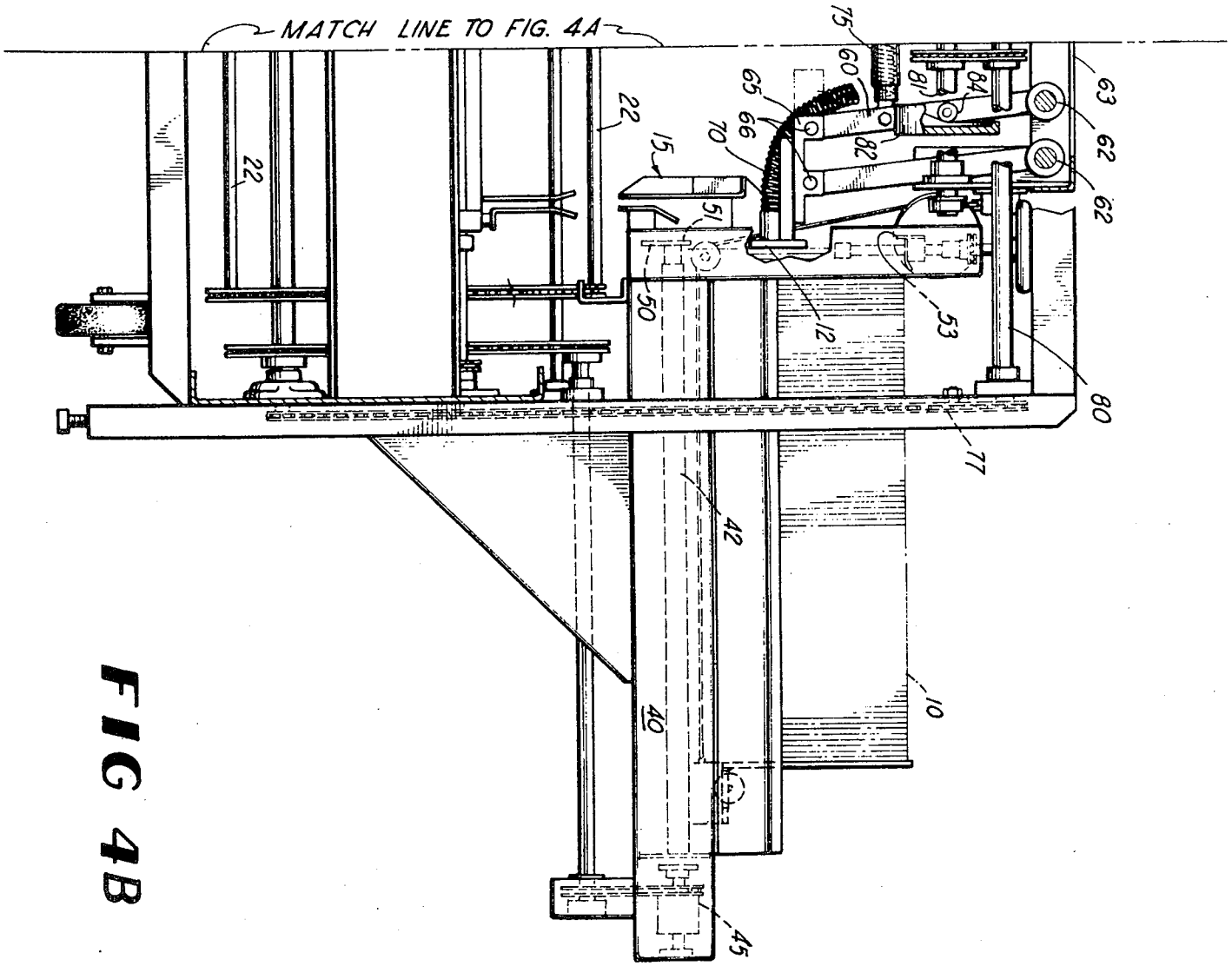
Figure 5:
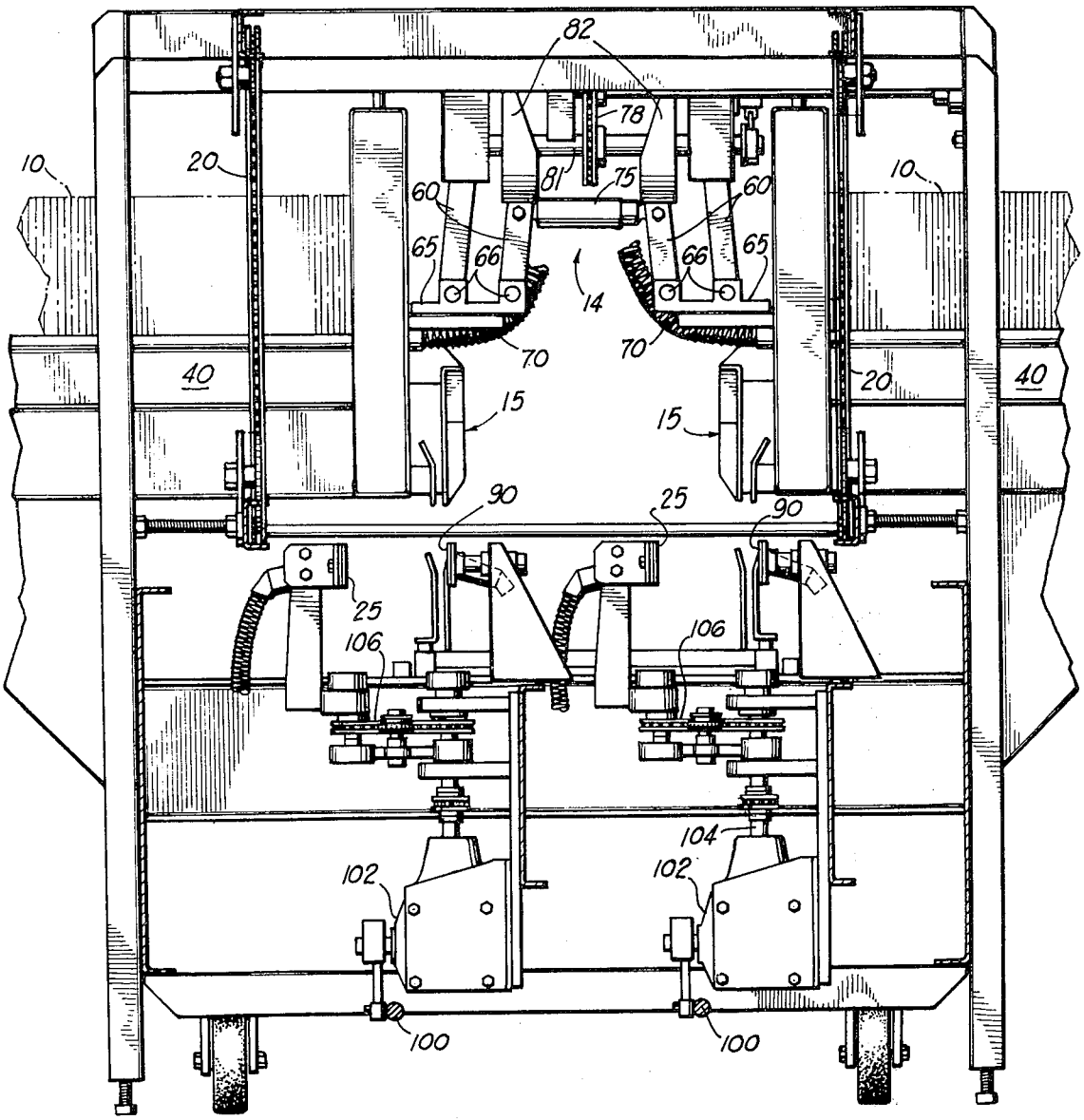
FIG. 5 is a cross-sectional view in elevation taken along plane 5—5 in FIG. 2B again illustrating portions of the machine devoted to case storage and dispensing as well as portions of the machine providing a case opening station.

With particular reference to FIGS. 4A, 4B and 5 carriage 14 is seen to comprise two pairs of parallel arms 60 mounted by pivot pins 62 to frame member 63. The lower ends of the arms are pivoted to plates 65 by pivot pins 66 to which plates suction cups 12 are rigidly mounted. Flexible hoses 70 extend from the suction cups to a rigid conduit 71 shown in FIG. 2A which communicates with a vacuum pump 72 supported upon the machine floor through a solenoid actuatable air valve 74.

As the pairs of parallel arms 60 are pivotally linked together at each end by rigid structures they function as two parallelogrammatic linkages which are biased apart by a compression spring 75. The parallelogrammatic linkages are driven with simple harmonic motion by a transmission system which includes a drive chain 77 coupled with primary drive chain 46. A secondary drive chain 78 serves to transmit the rotary motion imparted to a drive shaft 80 by chain 77 to secondary drive shaft 81. A pair of cams 82 are secured to the secondary shaft in rotary engagement with rollers 84 rotably mounted to one arm 60 in each pair of arms. It thus is seen that rotation of shafts 80 and 81 cause cams 82 to rotate and to urge the parallelogrammatic linkages of the carriage back and forth against the bias provided by compression spring 75. In this manner suction cups 12 are made to move at simple harmonic motion along a generally horizontal plane back and forth between positions above the case stops at the open end of the magazines and above drop chutes 15. Solenoid 74 is set by conventional limit switch means to operate in timed sequence with respect to the position of carriage 14 and suction cups 12 so as to couple the cups with the vacuum pump when they are positioned adjacent end members of stacks 10 and to diminish or break connection of the cups with the pump when positioned above the drop chutes to enable gripped end members to fall free of the cups down into the chutes.

III. CASE OPENING STATION

Figure 2A:
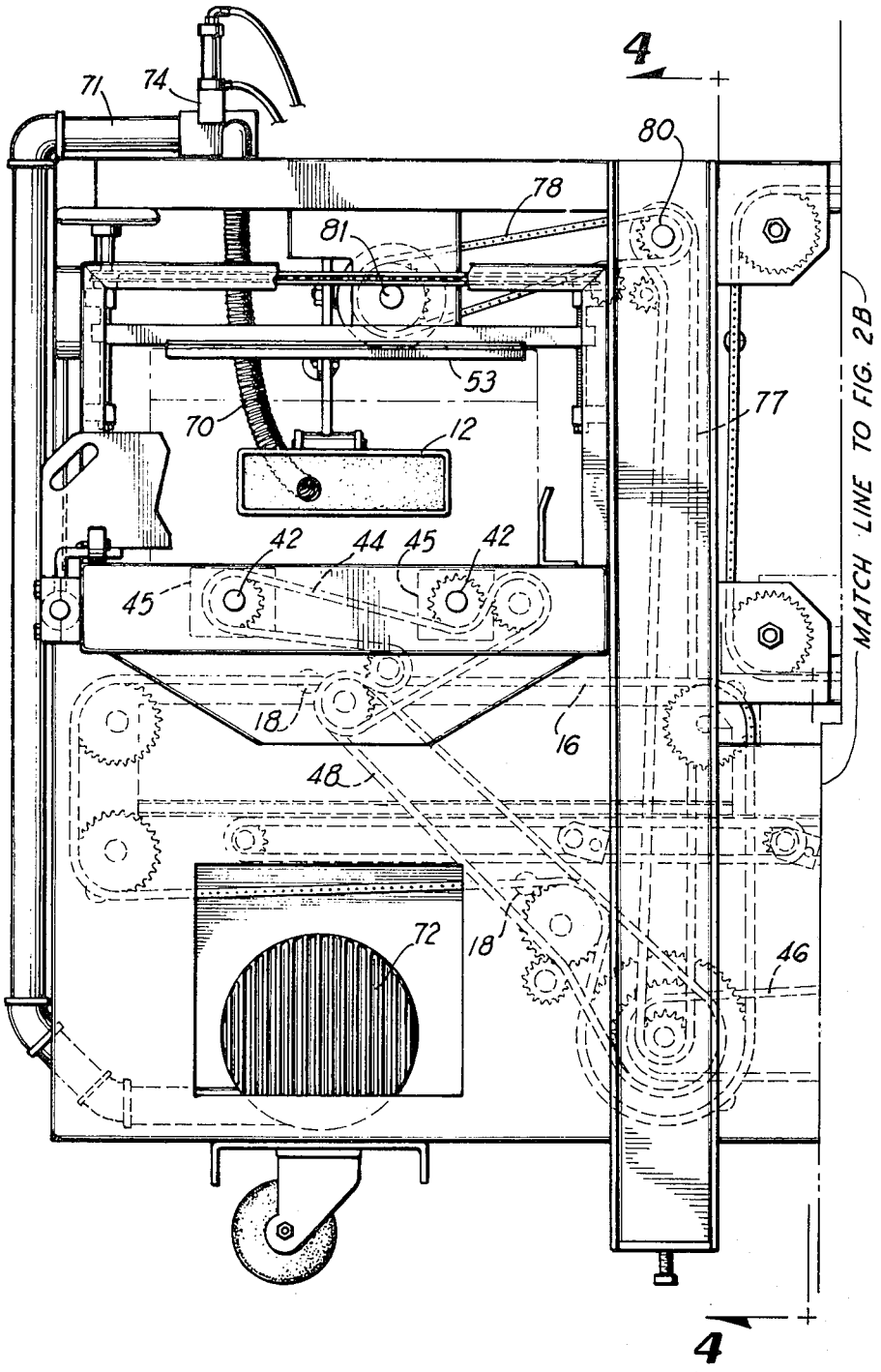
FIGS. 2A–2D are side views, in elevation, of consecutive longitudinal segmented portions of a specific machine of the type schematically illustrated in FIG. 1.
Figure 2B:
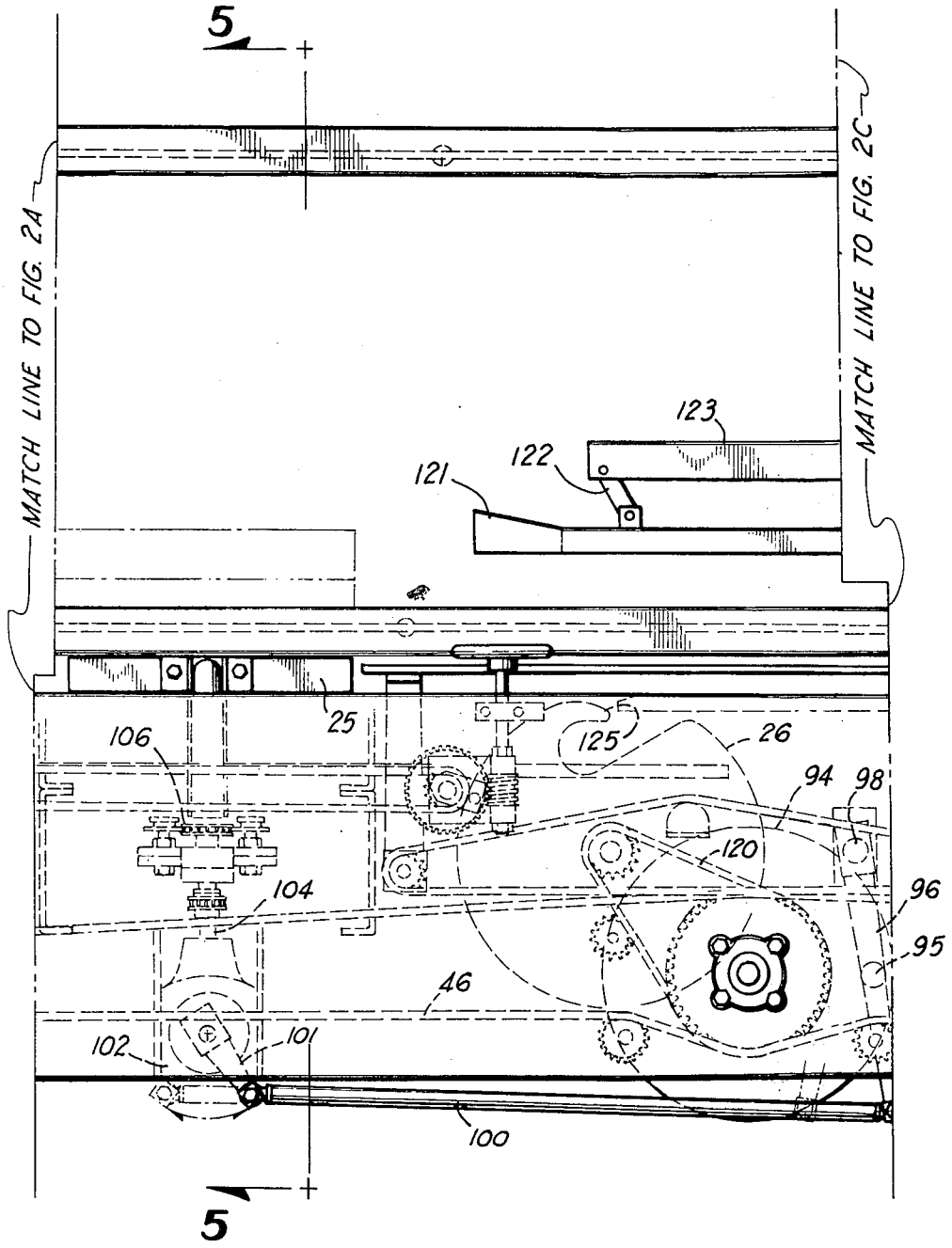

Referring next to FIGS. 2B and 5 the case opening station is seen to include the pair of movable suction cups 25 previously described, and a pair of stationary suction cups 90 facing the movable cups. The stationay suction cups are coupled with vacuum pump 72 through a solenoid operated valve that is operated in timed relation with the cyclic position of the movable suction cups. Preferably, the actuation of the solenoid is effected through limit switch means associated with the drive transmission mechanism now to be described for operating the movable cups.

The movable cups 25 are driven by primary drive chain 46 which directly rotates drive wheel 94 having a race therein in which is set a cam roller 95 mounted to crank arm 96 which arm is pivotally mounted to the machine frame by pivot pin 98. A linking arm 100 is pivoted to the end of crank arm 96 distal pin 98. The other end of arm 100 is pivoted to a second crank arm 101 that is pivoted to an angle gear box 102. An output shaft 104 extends upwardly out of the gear box. Suction cups 25 are in turn mounted above the output shaft with the cups pivotally coupled thereto by means of chain 106 whereby the orientation of the cup during pivotal movement remains directed towards the stationary cup.

Figure 8:
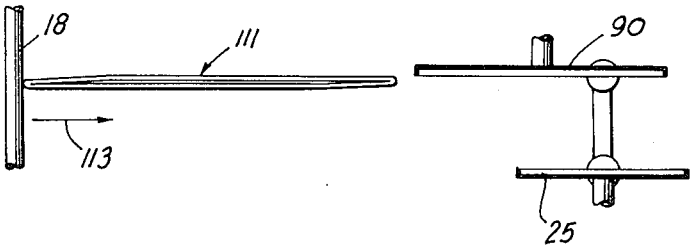
FIGS. 8–12 provide a sequence of views schematically illustrating case opening operations provided by the case opening station of the machine.
Figure 9:
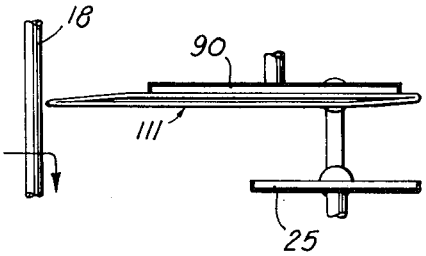
Figure 10:
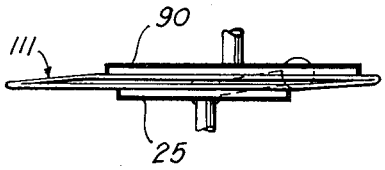
Figure 11:
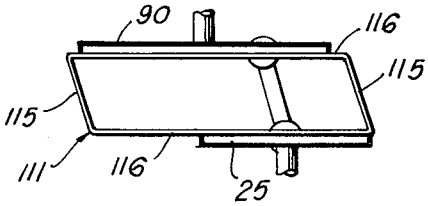
Figure 12:
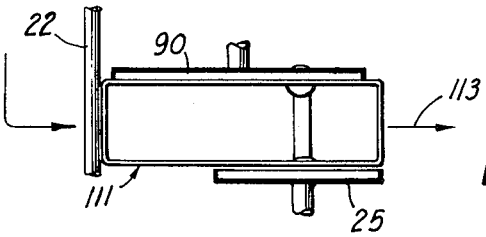

With reference to FIGS. 8–12 an operative sequence of events in performing a case opening operation may be visualized. In FIG. 8 a flight bar 18 is seen urging an unopened case III towards a pair of confronting suction cups 25 and 90. As the leading edge of the case passes over an initially engaged portion of the stationary cup 90 suction is applied thereto. At this point the entire suction cup is not covered by the case and thus the vacuum pressure applied thereto is only that sufficient to maintain the case vertically adjacent the cap. Continued movement of flight bar 18 causes the case to slide over the cup until the entire open portion thereof is covered by the case. At this point substantial suction is applied to the case holding it firmly to cup 90 and flight bar 18 reaches the end of its horizontal travel and descends in a vertical plane leaving the case held stationarily by the cup.

Next, the movable suction cup 25 is coupled to vacuum pump 72 and pivoted into gripping engagement with the other side of case III. The movable cup is then pivoted back away from the stationary cup to the position shown in FIG. 11 where it has traveled in the direction of arrows 113 a distance slightly greater than the width of case side 115. This movement causes the case to be overscored whereby the case ends 115 are brought beyond a point perpendicular to sides 116. The movable cup is then moved to the position shown in FIG. 12, suction reduced on both cups, and flight bars 22 brought into engagement with the case to urge it out of the case opening station with case sides 115 having sprung back from their overscored relative positions to one in which the sides are squared off. That the movement of the movable cups is of variable velocity is made possible and controlled by the shape of a race formed along a side of drive wheel 94 which guides crank arms 96 and 101.

IV. PANEL FOLDING AND GLUEING STATIONS

Figure 2C:
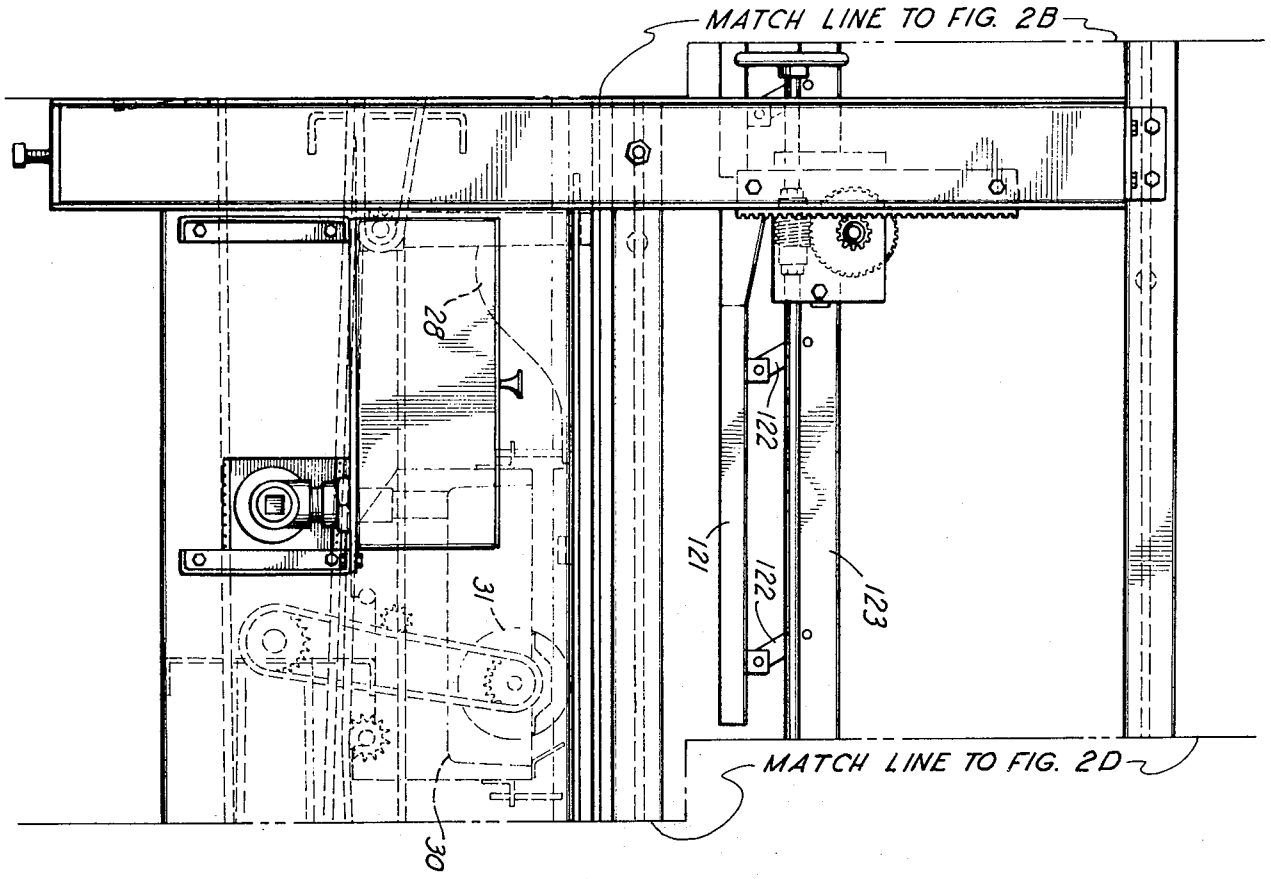
Figure 6:
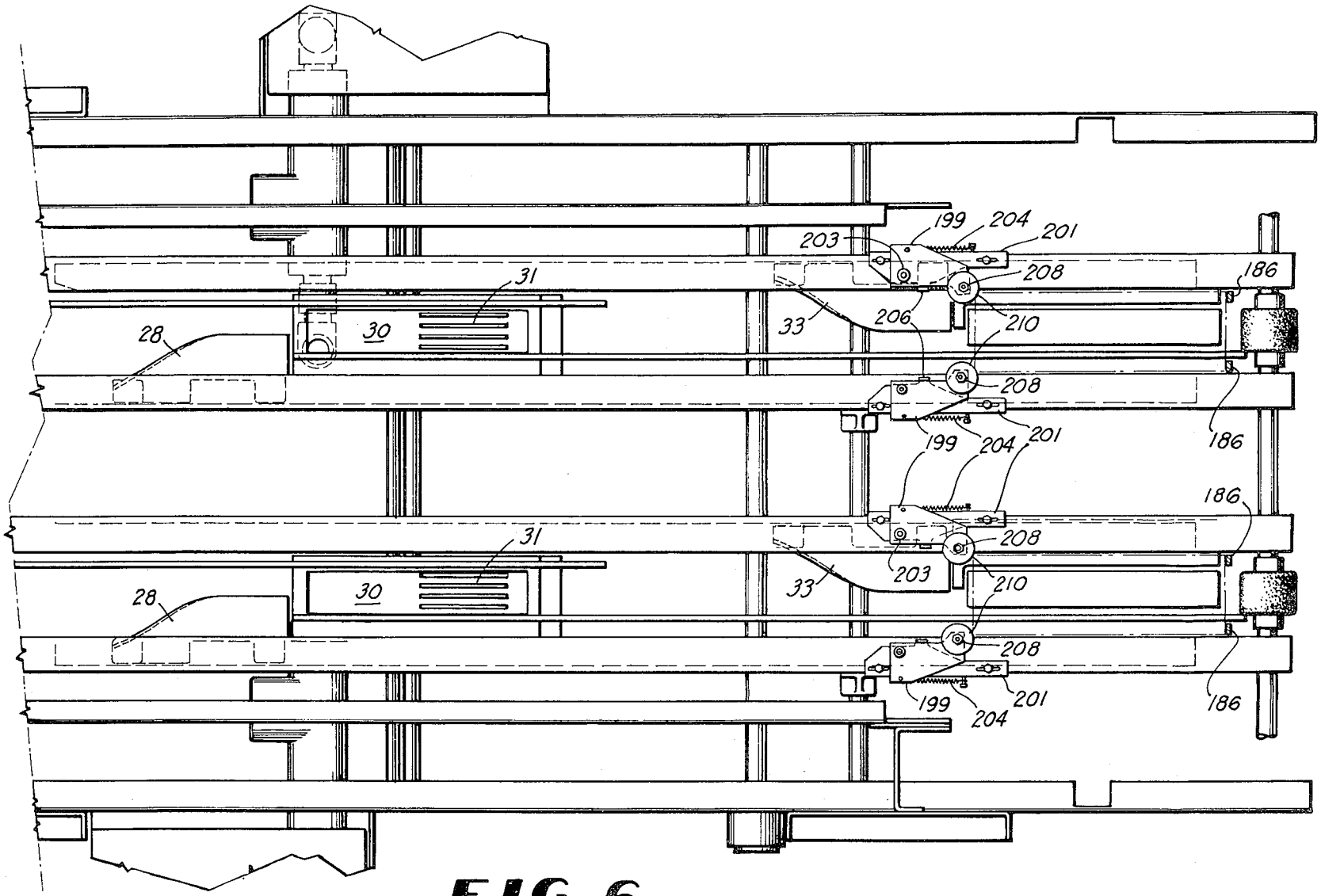
FIG. 6 is a plan view of portions of the machine shown in FIGS. 2A–2D providing case panel folding, glueing, and compression stations.

Referring now to FIGS. 2B, 2C and 6 the panel folding and glueing stations are seen to include a cam 26 for tucking in both bottom end flaps of the cases as they pass thereover. The cam is driven by a chain 120 coupled with drive wheel 94 which itself, as previously stated, is driven by the main drive chain 46. As the opened cases are urged by flight bars 22 from the case opening station to a point above cams 26 their tops are brought into engagement with a swing bar 121 which is suspended by links 122 beneath frame member 123. They are then brough into engagement atop a circular segment of cam 26 which folds back the leading bottom end flap. During this operation the box is inhibited from lifting off the cam due to the weight thereatop provided by swing bar 121. The annular peripheries of cams 26 are detailed in configuration to include an overhanging ledge portion 125 which grips and tucks in the trailing bottom end flap of the case.

After this tucking of the end flaps flight bars 22 urge the cases over fixed cams 28 which fold one of the two bottom panels of the case to a substantially right angular relation with the case sides. Following this the cases are urged over glue boxes 30 bringing the folded bottom panel over glue applicator discs 31 which apply a coating of adhesive to the bottom surface of the foled panel and to the exposed portions of the bottom end flaps. From here the cases are urged over fixed cams 33 which fold in the other bottom panels to a position closely adjacent but slightly spaced from the folded bottom panel having the adhesive coating thereon.

V. PANEL COMPRESSION STATION

Figure 2D:
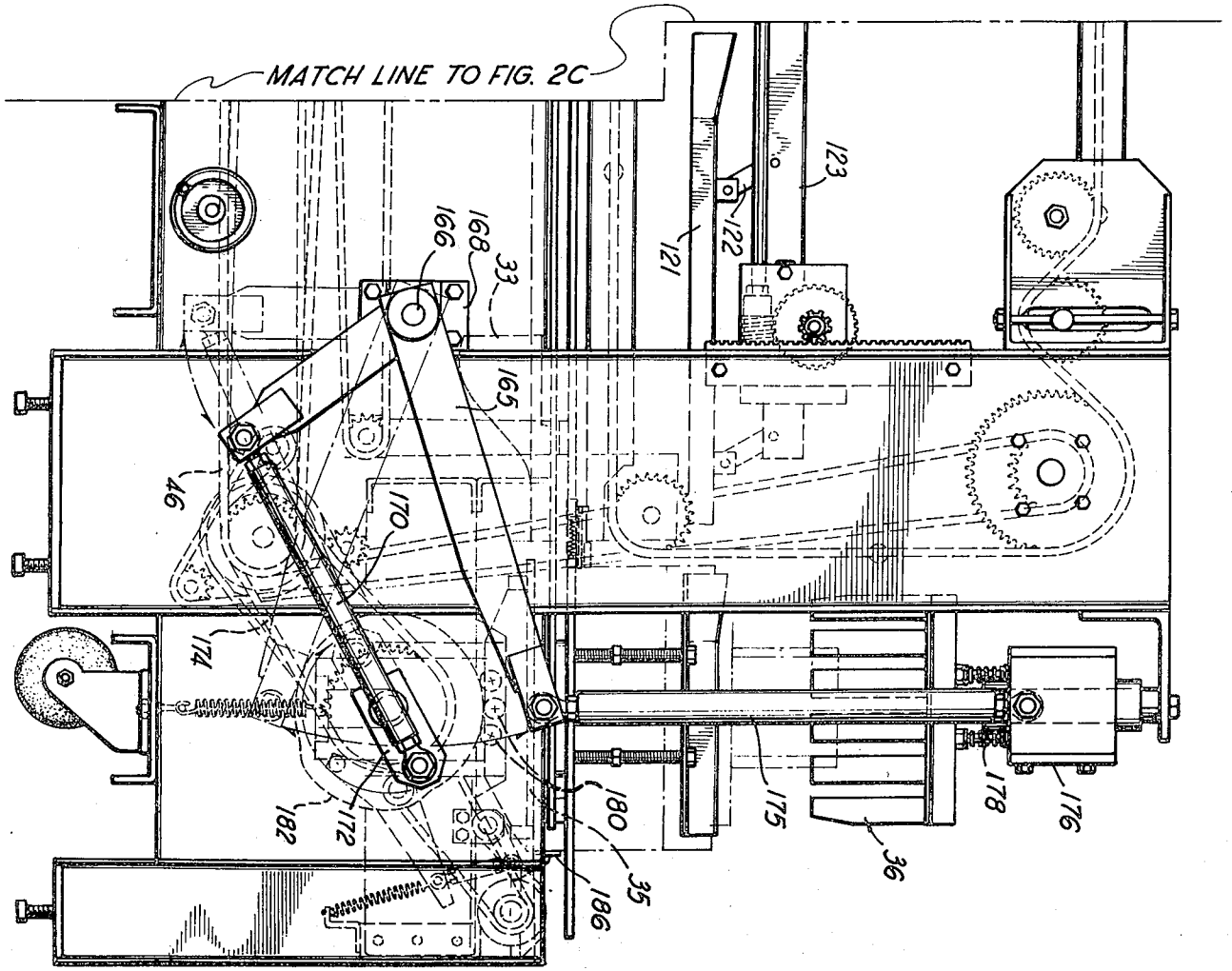
Figure 3:
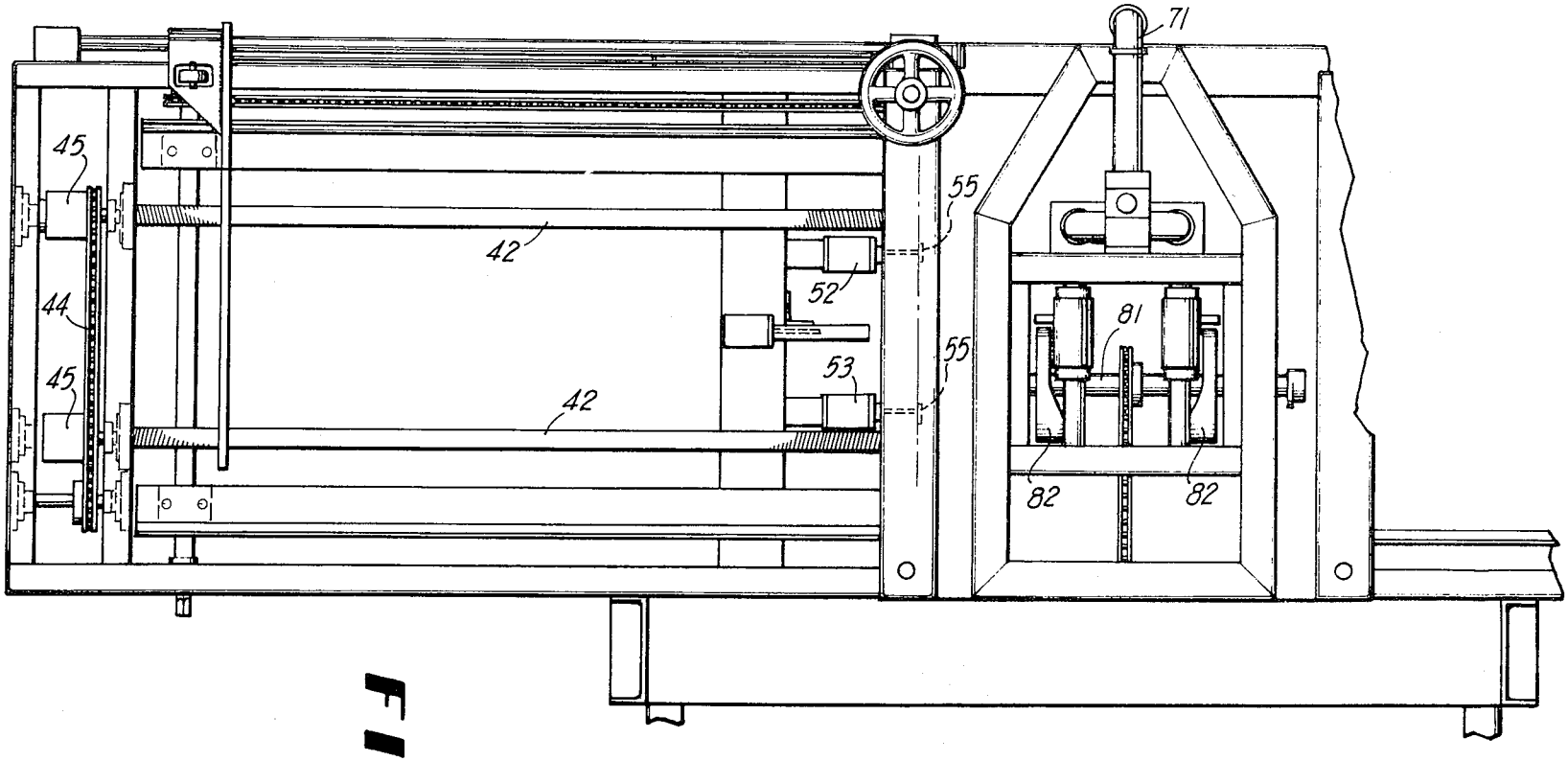
FIG. 3 is a plan view of a portion of the machine illustrated in FIG. 2A which provides case storage and dispensing stations.
Figure 7:
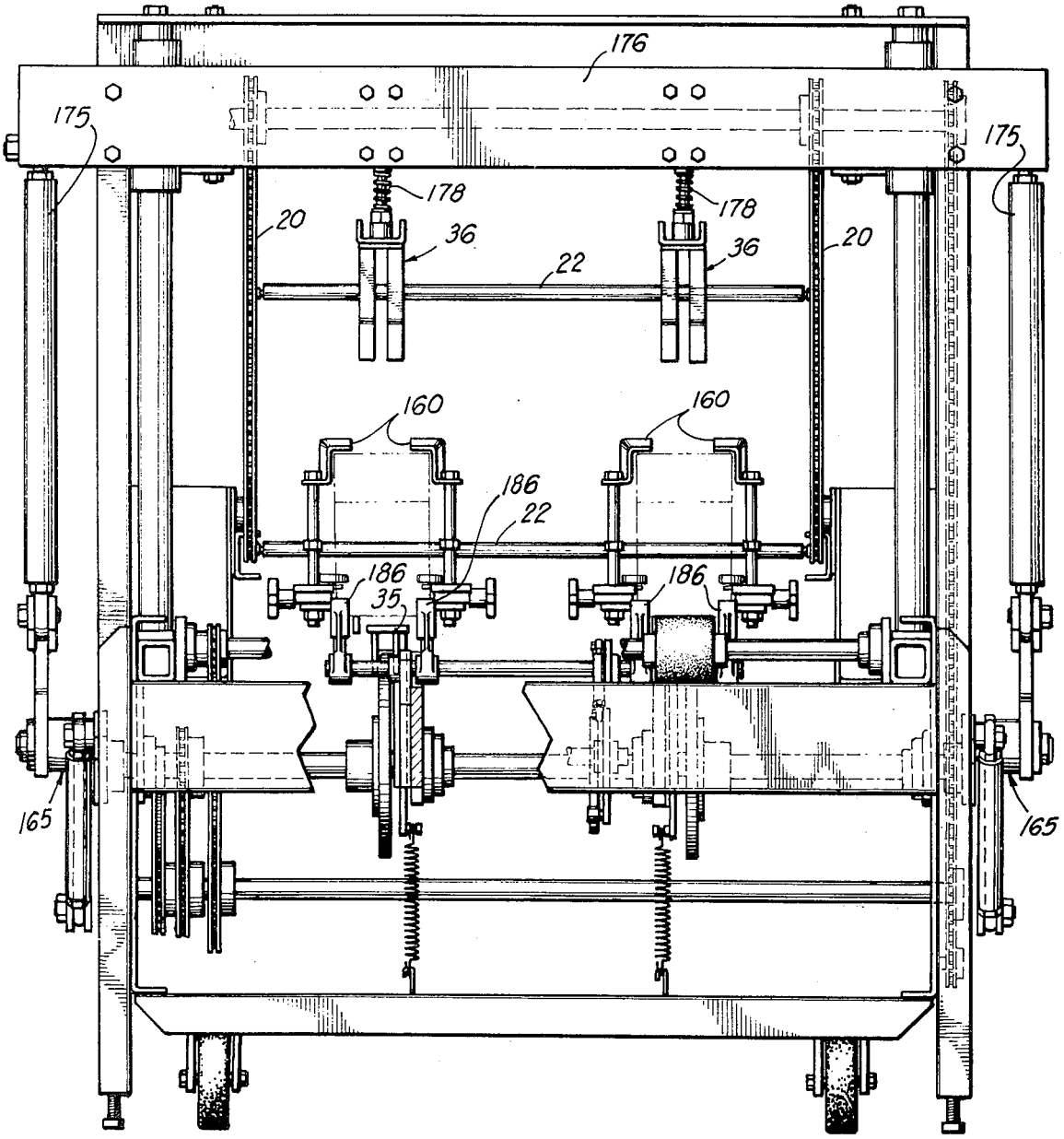
FIG. 7 is an end-on view in elevation of the rear of the machine depicted in FIGS. 2A–2D depicting portions of the machine providing the panel compression station.

Referring next to FIGS. 2D, 6 and 7 the apparatus for performing panel compression in sealing the bottom panels together is illustrated. The apparatus is seen to comprise two pairs of rigidly mounted hold-down bars 160 and a pair of mandrels 36 adapted to be raised and lowered through the fixed hold-down bars into the bounds of the opened cases in pressing the bottom case panels against anvils 35. The mandrels are moved by a mechanical transmission system which includes a bellcrank 165 mounted by pivot pin 166 to a frame member 168. A lower portion of the bellcrank is coupled by means of bellcrank arm 170 to a crank 172 which is rotated by means of chain 174 driven by main drive chain 46. The upper end of the bellcrank is pivoted to bellcrank arm 175 which in turn is coupled with sliding beam 176. A pair of compression springs 178 are disposed between mandrels 36 and the sliding beam.

Anvils 35 are mounted atop a set of rollers 180 which themselves are supported atop cam 182. The arcuate periphery of the cam is seen to include a humped portion 182 which raises and lowers rollers 180 once during each revolution of the cam. This action in turn urges anvils 35 upwardly in timed relation to the movement of mandrels 36. The relative movement is such that both the anvils and mandrels move in converging relationship upon opposite sides of the overlaying bottom panel members of the cases just as the mandrels approach their proximal position with respect to the anvil. At their point of closest, mutual approach the anvils urge the lowermost bottom panel member upwardly while the descending mandrels simultaneously urge the uppermost bottom panel member downwardly or at least prevent it from rising as the anvil pushes the lowermost panel upwardly. Springs 178 serve to provide a definitive time period for the compression operation to effect a good seal.

During the panel compression operation it is most important that the sides of the cases be squared off. Here, this is accomplished in part by means of stops 186 which are periodically moved in a vertical plane by the rotary movement of cam 182 to arrest movement of the cases being urged into the station by flight bars 22. That the leading ends of the cases are urged flush against the stops along a plane normal to the direction of case travel is accomplished by the mechanism illustrated most clearly in FIG. 6. This mechanism is seen to include a set of plates 199 pivotally mounted to angle irons 201 at fulcrum points 203. Tension springs 204 are provided to spring bias plates 199 to rotate about these fulcrum points. Atop each plate projects a stop 206 and a pivot pin 208 to which a roller 210 is mounted. In operation, cases are urged by flight bars 22 between pairs of plates with the leading end striking rollers 210 causing the plates to swing outwardly from the path of the cases. As the cases continue to be urged toward stops 186 rollers 210 roll along the sides of the cases. The distance that the rollers are positioned from stops 186 is such as to cause the rollers to round the trailing corners of the cases just as stops 186 are engaged. This action serves to square the cases in a position manner by biasing them against the stops. Once this is achieved the mandrels are lowered into the cases without danger of striking one of the case sides and yet with the mandrel dimensioned so as to cover fully the bottom of the cases to insure full compression of the bottom panels.

Throughout the machine there are numerous features provided for making adjustments to readily convert the machine to process cases of varying size. Many of these adjustment features are shown in the drawings but for brevity have not been described in detail. Many modifications may, of course, be made to the specifically illustrated embodiments of the invention without departure from the spirit and scope thereof as set forth in the following claims.

I claim:

1. In a case erecting machine apparatus for squaring the sides of cases being moved along a preselected path, said apparatus comprising a case stop; means for positioning said stop along said path; a pair of mounting plates pivotally mounted to opposite sides of said path; spring means biasing said mounting plates inwardly towards said path; and a pair of rollers rotatably supported upon said mounting plates for rotatable engagement with the sides of the cases.

2. The apparatus of claim 1 comprising a pair of plate stops for limiting inward movement of said mounting plates towards said path.

3. The apparatus of claim 1 comprising means for adjusting the distance said rollers are supported from said casee stop.

* * * * *